US006365835B1

(12) United States Patent
Farmer

(10) Patent No.: US 6,365,835 B1
(45) Date of Patent: Apr. 2, 2002

(54) FULLY-TERMINATED SOLID-CORE WIRE CABLE

(76) Inventor: Kenneth J. Farmer, 3414 Lexington, Waterford, MI (US) 48348

( * ) Notice: Subject to any disclaimer, the term of this patent is extended or adjusted under 35 U.S.C. 154(b) by 0 days.

(21) Appl. No.: 09/312,258

(22) Filed: May 14, 1999

Related U.S. Application Data

(60) Provisional application No. 60/085,507, filed on May 14, 1998.

(51) Int. Cl.[7] ..... H01B 7/36
(52) U.S. Cl. ..... 174/112
(58) Field of Search ..... 174/112, 113 R, 174/69

(56) References Cited

U.S. PATENT DOCUMENTS 3,031,524 A * 4/1962 Hicks ..... 174/112
3,324,229 A * 6/1967 Ingmanson ..... 174/69
3,954,320 A * 5/1976 Hardesty ..... 439/676
3,993,860 A * 11/1976 Snow et al. ..... 174/69
4,166,881 A * 9/1979 Congdon et al. ..... 174/69
4,910,359 A * 3/1990 Dougherty et al. ..... 174/69
4,939,778 A * 7/1990 Tomberlin ..... 379/438
4,997,994 A * 3/1991 Andrews et al. ..... 174/112
5,502,288 A * 3/1996 Cogen et al. ..... 174/113 R
5,828,726 A * 10/1998 Polichar et al. ..... 378/98.2
5,913,702 A * 6/1999 Garcin ..... 439/676
6,037,546 A * 3/2000 Mottine et al. ..... 174/113 R X

* cited by examiner

*Primary Examiner*—Chau N. Nguyen
(74) *Attorney, Agent, or Firm*—Lynn E. Cargill; Susan M. Cornwell

(57) ABSTRACT

An electrical cable includes a solid-core wire; an outer sheath surrounding the solid-core wire; and a connector attached directly to each end of the cable. The electrical cable may have a code marked on the outer sheath of the cable near each end of the cable in which the code is individualized for that particular electrical cable. The code may also be marked at intervals along the length of the cable, for example about every one to five feet. The cable may have at least eight solid-core wires, each wire being at least 24 gauge or heavier; an outer sheath surrounding the at least eight solid-core wires; and a factory/field-attached RJ45 connector attached directly to each end of the cable, wherein each connection is factory or factory-quality tested. The cable may be at least 60 feet long.

1 Claim, 1 Drawing Sheet

FULLY-TERMINATED SOLID-CORE WIRE CABLE

This patent application claims the benefit of prior filed U.S. Provisional Patent Application No. 60/085,507 filed on May 14, 1998, now abandoned which Provisional Patent Application is incorporated by reference herein.

BACKGROUND OF THE INVENTION

1. Field of the Invention

The present invention relates generally to electrical cables and, more particularly, to solid-core wire electrical cables.

2. Description of the Related Art

In today's modern office buildings, there are numerous applications for wiring of computers and other data or audio transmitting devices that require lengthy pieces of cable to be installed behind walls, under floors, etc. The cable generally terminates in the room where the computer or other device needs to be plugged in. Usually, a patch cord, which is conventionally formed of stranded core wire, may be connected to one end of the lengthy cable while the other end of the patch cord is terminated with a connector and connected to the computer or other device.

Currently, commercially available patch cords formed of stranded core wires are not longer than 25 feet so as to avoid adverse effects, such as magnetic fields and other interferences created by the wiring. However, many computers and other applications must be reliably connected by cables that are longer than that, without imparting any type of wiring interferences or any problems created by the discontinued connection between the cable and the patch cord.

The current practice is to run application-specific cabling, with the installing contractor splicing and attaching patch cords to cables and attaching termination connectors on the ends of the cable before installing into the necessary application. Unfortunately, these installer-attached termination connectors are prone to quality control problems, as they were not made in a consistent manner.

In addition to the ever present "splicing" problems created, these installer-attached termination connectors give rise to a number of problems later, as each of the connections must be individually field tested by the installer in order to make sure that the connections are proper. This testing can take many hours, costing a great deal in labor, all without the kind of reliability which is necessary for a quality installation.

Furthermore, such wiring of data signal distribution applications can present problems later when the computer or other device is physically moved, and these installer-attached terminated cables remain unmarked, causing numerous field tests to determine which cable end corresponds to another cable end in a distant room or through a wall.

For instance, a typical installation involves an installer beginning with a cable at one location, pulling the unmarked cable through walls and ceilings toward the ultimate destination, and putting a termination connector on one end of the cable (to be connected to a computer) in an entirely different room in the building. Then, five years later, if the computer is moved, the cables will need to be identified in order to connect the computer properly in a new location. With the hundreds of wires that are now hidden behind wall panels and ceilings in between the old location and the new location, it is very difficult to trace the cable back to its original source without tearing down the walls. This happens every day in corporate America, with the frequent movement of personnel. The identification and re-testing of the existing cables is extremely difficult and unreliable.

As it would be most advantageous to re-use the cabling that is already in place, a great deal of man-hours must be expended to ascertain which cable to use. This is especially true since there would not have been any standardization applied to the existing cable infrastructure, as it was individually hand done by the contracted individual installer years earlier. So, in the unlikely event that the location of the proper cable is known, the cable still needs to be tested throughout its length to make sure that the cable is continues to be suitable and is still sound for the new application.

With the problems of the prior art in mind, the present invention seeks to provide a fixed length electrical cable suitable for telecommunications and capable of being made into long lengths while exhibiting consistently high quality and reliability, while being easy to use and labor saving.

Another advantage being sought by the present invention is an electrical cable which is designed so that, once the cable is installed, it is easy to determine which termination ends correspond to the same cable.

SUMMARY OF THE INVENTION

In accordance with the present invention, the broadest embodiment includes a fully terminated fixed length solid core wire electrical cable, i.e. an electrical cable which includes a solid-core wire, an outer sheath surrounding the solid-core wire, and a connector attached directly to each end of the cable. In a preferred embodiment, the electrical cable has a code marked on the outer sheath of the cable near each end of the cable in which the code is individualized for that particular electrical cable. The code may also be marked at intervals along the length of the cable, for example about every one to five feet.

In another preferred embodiment, the cable is at least 60 feet long and has at least eight solid-core wires, each wire being at least 24 gauge or heavier; an outer sheath surrounding the at least eight solid-core wires; a factory/field-attached and tested RJ45 connector attached directly to each end of the cable, each connection being factory or factory-quality tested; and a code marked on the sheath about every one to five feet along the length of the cable, wherein the code is individualized for the electrical cable.

Other advantages of the present invention will be readily appreciated as the same becomes better understood after reading the subsequent description.

DESCRIPTION OF THE PREFERRED EMBODIMENT(S)

The present invention generally entails an electrical cable containing solid-core wire, having an outer sheath surrounding the solid-core wire, and a connector attached directly to each end of the cable.

Figure 1:
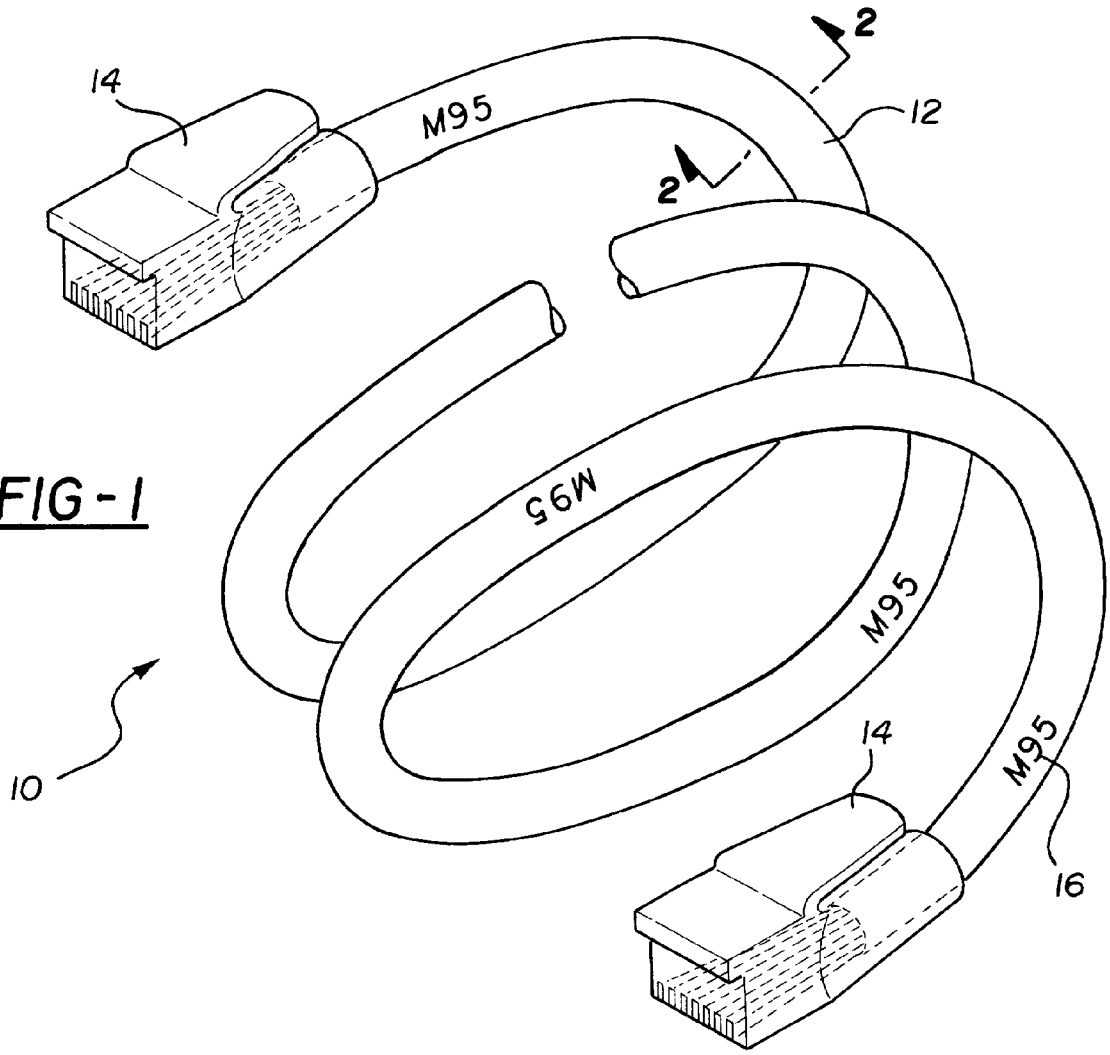
FIG. 1 is a perspective view of a fully-terminated solid-core wire cable made in accordance with the present invention.

FIG. 1 shows a cable made in accordance with the present invention, and the cable is generally denoted by the numeral 10. The wire 12 includes termination connectors 14 attached to the two ends of wire 12, with code markings 16 located throughout the length of the cable 10.

The electrical cable of the present invention is preferably certified data cabling which is especially suitable for networking communication equipment, such as computers, telephones, facsimile machines, and telephone answering machines. The most desirable communication cables are made in accordance with NEC 800 standards that were in effect in the year this application was filed, i.e. 1999, although many other cable standards can be met by the selection of the appropriate core.

Most desirably, the cables of the present invention are suitable for horizontal cabling and comply with riser-rated and plenum-rated applications in the building backbone. Preferably, the cables of the present invention meet the standard of Category 5, 100 MHz rating, or the new enhanced 350 MHz rating, in addition to BCSI standards, North American ANSI/TIA/EIA-568-A, International ISO/IEC 11801, or European EN 50173. Most preferably, the cables meet gigabit standards which will enable the eventual elimination of componentry and racks, so that electrical communication can be directly from the hub (or central communication distribution point) to the computer or other device. These cables will eliminate any componentry between the hub and the device are sometimes referred to as plug-and-play cables. Further, this will enable Category 6 installations and gigabit application.

Figure 2:
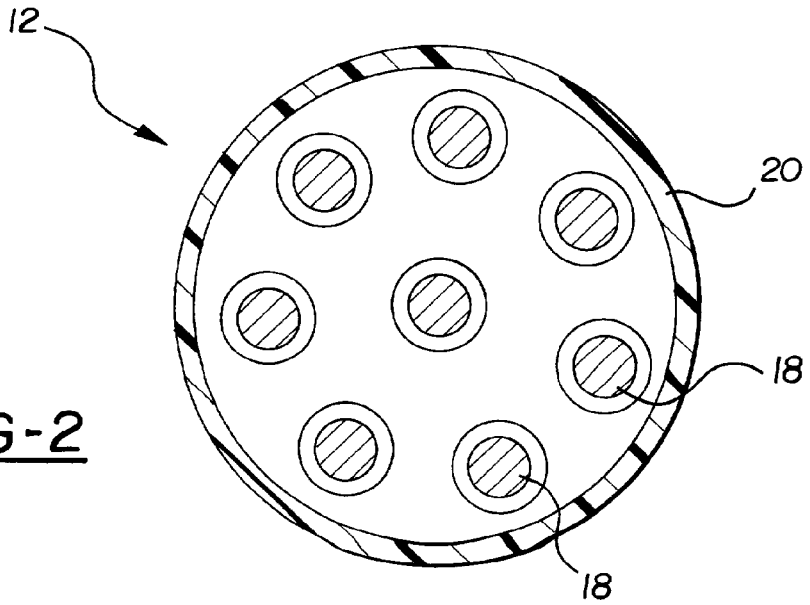

FIG. 1 illustrates the cable of the present invention and is generally denoted by numeral 10. Cable 10 includes a wire portion 12 and connectors 14 at either end. Serial numbers 16 are uniformly disbursed throughout the length of the wire portion 12 for identification purposes. FIG. 2 shows a preferred embodiment for the wire portion 12, including eight solid-core wires 18 incased by a polymeric outer sheath 20.

Inside the cable there are preferably at least eight solid-core (as opposed to stranded or braided) wires or four pairs of wires. Each solid-core wire is either coated or wrapped with a material such as plastic, rubber, or a paper product. Advantageously, the individual wires are at least 24 gauge or heavier, more advantageously, at least 18 gauge or heavier, and most advantageously, at least 12 gauge or heavier. The wire may be formed of AWG copper.

The sheath on the outside of the cable, covering the wires, may be formed of any of many suitable materials, such as flame retardant PVC, vinyl, non-plenum or "PLENUM", a cable covering material available from DuPont, Wilmington, Del.

As part of the manufacturing of the cables, the cables of the present invention are fully-terminated (i.e., terminated at each end) with a male or female connector designed to plug into various devices. If the cable has two ends, the cable is "dual-terminated". The connectors provide termination for the cable to give potential access to each transmission element (such as "pairs of wires"). When the cables are fully terminated and joined to each other or to the appropriate devices, they provide a continuous path for signal transmission.

The connectors are generally standard-type connectors which render the cables "modular" or capable of being used in a variety of applications. The connectors may be the common RJ45 telephone jack connectors, i.e. the connectors described by U.S. Pat. No. 3,954,320 to Hardesty, which patent is incorporated herein by reference, or any other known connector. The connectors may include means for prevention of pull-out, in order to protect the connections, which means are known in the art.

The connectors are attached directly to each end of the solid-core wire cable. In other words, there are no other cables, such as stranded wire cables, between the connectors and the solid-core wire cable. In addition, the connectors are attached at the factory or in the field with factory-quality equipment, so that the connection between the connector and the wires are tested at the factory or with factory-quality field testing. An installer may simply obtain one of the modular cables and install it, knowing that it has already been certified and tested for a particular application. Since the ends of the cable are pre-terminated, the installer merely needs to run the cable and plug the two ends of the cable into their respective hub or device to complete the installation.

In one embodiment of the present invention, the cable is marked on the outside near each end of the cable with a code. The code is individualized for each electrical cable, such as a serial number, so that the installer will know from seeing the end which wire it is. With the cable-specific coding, the installation may be split between two or more installers, rather than one installer having to perform installation of the cable from start to finish. Alternatively, and for some applications, it may be preferred that the cable is codemarked at regular intervals along its length, e.g., at about every one to five feet. The coding is preferably visible to the naked eye, but may be mechanically, electronically, or otherwise detectable. For example, the coding may be placed on a tag attached to the cable or may be marked as disclosed in U.S. Pat. No. 4,997,994 to Andrews et al., which patent is incorporated herein by reference. The cables may also be colored for identification.

The cables of the present invention may be made in various fixed lengths, such as 25', 60', 90', 120, and 300' and are spooled for ease-of-use. The cables are typically spooled on spools of from about 5 to about 10" in diameter to allow for ease of installation. Preferably, the length is at least 60' to be usable in more applications. However, the fixed length may be any length from about 25' to about 300' if an application calls for a particular length.

Depending on the application, the cables of the present invention may be made according to specifications on impedance, attenuation, capacitance, and/or resistance values. Compatibility checks may be determined for pair combinations. The particular cable used would be selected based on these values and on the length required. With the cables of the present invention, a building can be wired much more easily with much greater certainty.

Consequently, due to the present invention, cable communications between hubs or telecommunication closets and work areas can be much more reliable, much easier to install, better for re-connecting and moving, and perform its function efficiently over time. The cables of the present invention provide a way to connect these important devices without splices, field-added connections, or any other interruption in the cable. In all, the present cables will provide better connections that will outperform the current means for connection.

What is claimed is:

1. A certified voice, data and communication transmission wire cable, comprising:

at least eight solid-core certified voice, data and communication transmission wires made in accordance with NEC 800 standards that were in effect in the year 1999 and being at least a category 5 cable capable of transmitting at least 100 MHz, each wire being at least 24 gauge or heavier;

an outer sheath surrounding the at least eight solid-core wires, the outer sheath having individually cable specific coded serial numbers marked thereon at least near each end of the cable so that the cable may be identified individually during reconstruction or relocation of the cable; and a structurally certified and guaranteed electrically connected, factory-attached RJ45 connector attached directly to each end of the cable, each connection between the cable and the connector being factory-tested to certify that the connection is assured of a solid electrical connection;

the cable being at least 25 feet long.

* * * * *